US007279841B2

(12) United States Patent
Fukuyo et al.

(10) Patent No.: US 7,279,841 B2
(45) Date of Patent: Oct. 9, 2007

(54) ARC TUBE FOR A DISCHARGE LAMP

(75) Inventors: Takeshi Fukuyo, Shizuoka (JP); Michio Takagaki, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/010,293

(22) Filed: Dec. 14, 2004

(65) Prior Publication Data

US 2005/0146275 A1 Jul. 7, 2005

(30) Foreign Application Priority Data

Dec. 19, 2003 (JP) ..... P.2003-422014

(51) Int. Cl.
*H01J 17/20* (2006.01)
*H01J 61/20* (2006.01)

(52) U.S. Cl. ..... 313/642; 313/641; 313/639; 313/637

(58) Field of Classification Search ..... 313/637–643
See application file for complete search history.

(56) References Cited

U.S. PATENT DOCUMENTS 6,265,827 B1 * 7/2001 Takahashi et al. ..... 313/638
6,271,628 B1 * 8/2001 Sugitani et al. ..... 313/637
2003/0189408 A1 * 10/2003 Lapatovich et al. ..... 313/637
2004/0113557 A1 * 6/2004 Scott et al. ..... 313/634
2005/0093455 A1 * 5/2005 Tamura et al. ..... 313/638

FOREIGN PATENT DOCUMENTS

JP 2002-93369 A 3/2002

* cited by examiner

*Primary Examiner*—Joseph Williams
*Assistant Examiner*—Bumsuk Won
(74) *Attorney, Agent, or Firm*—Sughrue Mion, PLLC

(57) ABSTRACT

An arc tube for a discharge lamp has a closed chamber filled with rare gas and a metal halide containing at least Na halide or Sc halide, and electrodes, wherein sealing pressure of the rare gas is 0.6 MPa or more, and a sealing density of the Sc halide in the closed chamber is ranging from 1.25 to 4.70 mg/ml. In the arc tube, since the Xe gas sealing pressure slightly higher than 0.6 MPa, the pressure in the closed chamber is increased during its lightening state. Thus, reactions leading to a flicker occurrence may be accelerated. However, the flicker occurrence can be suppressed by setting the Sc halide sealing density to 4.70 mg/ml or less. Further, a luminous efficiency required for the lamp can be assured by setting the Sc halide sealing density to 1.25 mg/ml or more.

12 Claims, 13 Drawing Sheets

FIG. 2

| | |
|---|---|
| VESSEL | QUARTS GLASS |
| INTERNAL VOLUME | 0.032ml INNER DIAMETER (3.2mm) |
| RARE GAS SEALING PRESSURE | Xe (0.2, 0.4, 0.6, 0.8, 1.0MPa) |
| BUFFER SUBSTANCE | Hg (0.72mg) |
| LUMINOUS SUBSTANCE | Na-$ScI_3$ BASE<br>(NaI : $ScI_3$ = 65 : 35 (wt%) 0.3mg) |
| ELECTRODE | THORIATED TUNGSTEN<br>(OUTER DIAMETER 0.25mm STRAIGHT) |
| INTER-ELECTRODE DISTANCE | 3.8mm |

FIG. 3

| | | Xe: 0.2MPa | Xe: 0.4MPa | Xe: 0.6MPa | Xe: 0.8MPa | Xe: 0.10MPa |
|---|---|---|---|---|---|---|
| TUBE VOLTAGE | 85 ± 12 | 82 | 84 | 87 | 90 | 93 |
| LUMINOUS FLUX | 3200 ± 450 | 3000 | 3100 | 3200 | 3400 | 3600 |
| LUMINOUS FLUX BUILD-UP 1 SEC | 800 MIN | 600 X | 800 | 1050 | 1100 | 1150 |
| LUMINOUS FLUX BUILD-UP 4 SEC | 1200 MIN | 700 X | 900 X | 1250 | 1400 | 1600 |
| EVALUATION RESULT OF THE INITIAL | ALL SATISFIED? | X | X | O | O | O |

FIG. 5A

| | |
|---|---|
| VESSEL | QUARTS GLASS |
| INTERNAL VOLUME | 0.032ml INNER DIAMETER (3.2mm) |
| RARE GAS SEALING PRESSURE | Xe (0.78MPa) |
| BUFFER SUBSTANCE | Hg (0.72mg) |
| LUMINOUS SUBSTANCE | Na-$ScI_3$ BASE |
| ELECTRODE | THORIATED TUNGSTEN (OUTER DIAMETER 0.25mm STRAIGHT) |
| INTER-ELECTRODE DISTANCE | 3.8mm |

FIG. 5B

| NO. | NaI : $ScI_3$ (wt%) | SEALED QUANTITY (mg) | $ScI_3$ SEALING DENSITY (mg/ml) | XENON PRESSURE (MPa) | NUMBER OF FLICKER OCCURRENCE (OCCURRING RATE) | INTER-ELECTRODE DISTANCE (mm) | EVALUATION |
|---|---|---|---|---|---|---|---|
| 2-1 | 75 : 25 | 0.5 | 3.9 | 0.78 | 0/9 (0%) | 3.92 | O |
| 2-2 | 70 : 30 | 0.2 | 1.9 | 0.78 | 0/5 (0%) | 3.93 | O |
| 2-3 | 70 : 30 | 0.5 | 4.7 | 0.78 | 0/9 (0%) | - | O |
| 2-4 | 65 : 35 | 0.2 | 2.2 | 0.78 | 0/5 (0%) | 3.92 | O |
| 2-5 | 65 : 35 | 0.3 | 3.3 | 0.78 | 0/10 (0%) | - | O |
| 2-6 | 65 : 35 | 0.5 | 5.5 | 0.78 | 4/9 (44%) | 4.06 | X |
| 2-7 | 60 : 40 | 0.3 | 3.8 | 0.78 | 0/9 (0%) | 3.97 | O |
| 2-8 | 60 : 40 | 0.5 | 6.3 | 0.78 | 6/9 (67%) | 4.12 | X |

FIG. 6A

| | |
|---|---|
| VESSEL | QUARTS GLASS |
| INTERNAL VOLUME | 0.023ml INNER DIAMETER (2.6mm) |
| RARE GAS SEALING PRESSURE | Xe (0.78MPa) |
| BUFFER SUBSTANCE | Hg (0.72mg) |
| LUMINOUS SUBSTANCE | Na-$ScI_3$ BASE |
| ELECTRODE | THORIATED TUNGSTEN (OUTER DIAMETER 0.25mm STRAIGHT) |
| INTER-ELECTRODE DISTANCE | 3.8mm |

FIG. 6B

| NO. | NaI : $ScI_3$ (wt%) | SEALED QUANTITY (mg) | $ScI_3$ SEALING DENSITY (mg/ml) | XENON PRESSURE (MPa) | NUMBER OF FLICKER OCCURRENCE (OCCURRING RATE) | INTER-ELECTRODE DISTANCE (mm) | EVALUATION |
|---|---|---|---|---|---|---|---|
| 3-1 | 65 : 35 | 0.2 | 3.0 | 0.78 | 0/5 (0%) | - | O |
| 3-2 | 65 : 35 | 0.2 | 3.5 | 0.78 | 0/5 (0%) | 3.93 | O |

FIG. 7A

| | |
|---|---|
| VESSEL | QUARTS GLASS |
| INTERNAL VOLUME | 0.024ml INNER DIAMETER (2.7mm) |
| RARE GAS SEALING PRESSURE | Xe (0.78MPa) |
| BUFFER SUBSTANCE | Hg (0.72mg) |
| LUMINOUS SUBSTANCE | Na-$ScI_3$ BASE |
| ELECTRODE | THORIATED TUNGSTEN (OUTER DIAMETER 0.25mm STRAIGHT) |
| INTER-ELECTRODE DISTANCE | 3.8mm |

FIG. 7B

| NO. | NaI : $ScI_3$ (wt%) | SEALED QUANTITY (mg) | $ScI_3$ SEALING DENSITY (mg/ml) | XENON PRESSURE (MPa) | NUMBER OF FLICKER OCCURRENCE (OCCURRING RATE) | INTER-ELECTRODE DISTANCE (mm) | EVALUATION |
|---|---|---|---|---|---|---|---|
| 4-1 | 65 : 35 | 0.2 | 2.9 | 0.78 | 0/5 (0%) | 3.93 | O |

FIG. 8A

| | |
|---|---|
| VESSEL | QUARTS GLASS |
| INTERNAL VOLUME | 0.020ml INNER DIAMETER (2.5mm) |
| RARE GAS SEALING PRESSURE | Xe (1.0, 1.1MPa) |
| BUFFER SUBSTANCE | InI, $SnI_2$ |
| LUMINOUS SUBSTANCE | Na-$ScI_3$ BASE |
| ELECTRODE | THORIATED TUNGSTEN (OUTER DIAMETER 0.25mm STRAIGHT) |
| INTER-ELECTRODE DISTANCE | 3.8mm |

FIG. 8B

| NO. | NaI : $ScI_3$ : InI : $SnI_2$ (wt%) | SEALED QUANTITY (mg) | $ScI_3$ SEALING DENSITY (mg/ml) | XENON PRESSURE (MPa) | NUMBER OF FLICKER OCCURRENCE (OCCURRING RATE) | INTER-ELECTRODE DISTANCE (mm) | EVALUATION |
|---|---|---|---|---|---|---|---|
| 5-1 | 60 : 32 : 2 : 6 | 0.2 | 3.2 | 1.1 | 0/3 (0%) | - | O |
| 5-2 | 60 : 32 : 2 : 6 | 0.3 | 4.8 | 1.0 | 1/5 (20%) | - | X |
| 5-3 | 60 : 32 : 2 : 6 | 0.3 | 4.8 | 1.1 | 1/5 (20%) | - | X |
| 5-4 | 60 : 32 : 2 : 6 | 0.4 | 6.4 | 1.1 | 3/3 (100%) | - | X |

FIG. 9A

| | |
|---|---|
| VESSEL | QUARTS GLASS |
| INTERNAL VOLUME | 0.020ml INNER DIAMETER (2.5mm) |
| RARE GAS SEALING PRESSURE | Xe (1.0, 1.1MPa) |
| BUFFER SUBSTANCE | InI, $ZnI_2$ |
| LUMINOUS SUBSTANCE | Na-$ScI_3$ BASE |
| ELECTRODE | THORIATED TUNGSTEN (OUTER DIAMETER 0.35mm STRAIGHT) |
| INTER-ELECTRODE DISTANCE | 3.8mm |

FIG. 9B

| NO. | NaI : $ScI_3$ : InI : $ZnI_2$ (wt%) | SEALED QUANTITY (mg) | $ScI_3$ SEALING DENSITY (mg/ml) | XENON PRESSURE (MPa) | NUMBER OF FLICKER OCCURRENCE (OCCURRING RATE) | INTER-ELECTRODE DISTANCE (mm) | EVALUATION |
|---|---|---|---|---|---|---|---|
| 6-1 | 57.5 : 27 : 0.5 : 15 | 0.3 | 4.1 | 1.1 | 0/3 (0%) | - | O |
| 6-2 | 62.5 : 27 : 1.5 : 9 | 0.2 | 2.7 | 1.0 | 0/3 (0%) | - | O |
| 6-3 | 62.5 : 27 : 1.5 : 9 | 0.2 | 2.7 | 1.1 | 0/3 (0%) | - | O |
| 6-4 | 62.5 : 27 : 1.5 : 9 | 0.3 | 4.1 | 1.0 | 0/3 (0%) | - | O |
| 6-5 | 62.5 : 27 : 1.5 : 9 | 0.3 | 4.1 | 1.1 | 0/3 (0%) | - | O |
| 6-6 | 62.5 : 27 : 1.5 : 9 | 0.4 | 5.4 | 1.1 | 2/3 (67%) | - | X |

FIG. 15

* NEGATIVE ELECTRODE: φ0.4 x 6 THORIATED TUNGSTEN, AND POSITIVE ELECTRODE: φ0.8 x 6 PURE TUNGSTEN

| | | LITERATURE EMBODIMENT 1 | LITERATURE EMBODIMENT 2 | LITERATURE EMBODIMENT 3 | LITERATURE EMBODIMENT 4 | LITERATURE EMBODIMENT 5 | LITERATURE EMBODIMENT 6 |
|---|---|---|---|---|---|---|---|
| INNER DIAMETER (mm) | | 4.0 | ← | ← | ← | ← | ← |
| INTERNAL VOLUME (ml) | | 0.05 | ← | ← | ← | ← | ← |
| INTER-ELECTRODE DISTANCE (mm) | | 4.2 | ← | ← | ← | ← | ← |
| $ScI_3$ (mg) | | 0.14 | ← | ← | ← | ← | 0.17 |
| NaI (mg) | | 0.86 | 0.7 | ← | ← | ← | 0.83 |
| SECOND HALIDE (mg) | | 1.0 | 0.4 | ← | 0.4 ($ZnI_2$) + 0.1 (OTHERS) | 0.4 + 0.1 (CsI) | 0.4 ($ZnI_2$) 0.2 ($AlI_3$) 0.4 ($FeI_2$) |
| XENON PRESSURE (MPa) | | 0.1 | 0.5 | ← | ← | ← | ← |
| TUBE POWER (W) | | 35 | ← | ← | ← | ← | ← |
| Hg QUANTITY (mg) | | - | 1 | ← | - | - | - |
| OUTER TUBE | | - | - | VACUUM | - | - | - |
| ELECTRODE | | - | - | - | - | - | * |
| MOLYBDENUM FOIL | | - | - | - | - | - | 1.5mm x 15mm (15μm) |
| EXTERNAL LEAD WIRE | | - | - | - | - | - | φ0.5 x 25 |
| TUBE VOLTAGE | 85 ± 12 | 37 | 77 | 80 | 42 | 38 | 44 |
| LUMINOUS FLUX | 3200 ± 450 | 2500 | 3100 | 3200 | 2300 | 2200 | 2400 |
| LUMINOUS FLUX BUILD-UP 1 SEC | 800 MIN | 100 | 700 | 800 | 600 | 500 | 600 |
| LUMINOUS FLUX BUILD-UP 4 SEC | 1200 MIN | 200 | 900 | 1000 | 800 | 700 | 800 |
| EVALUATION RESULTS OF INITIAL CHARACTERISTICS | ALL SATISFIED? | X | X | X | X | X | X |

ARC TUBE FOR A DISCHARGE LAMP

The present invention claims foreign priority to Japanese patent application No. 2003-422014, filed on Dec. 19, 2003, the contents of which is incorporated herein by reference.

BACKGROUND OF THE INVENTION

1. Field of the Invention

The present invention relates to an arc tube for a discharge lamp having a closed chamber, into which metal halides containing at least Na and Sc are sealed together with a rare gas, in which electrodes are provided to oppose to each other, and an internal volume of which is 50 μl or less.

2. Description of the Related Art

FIG. 14 shows a conventional discharge lamp. The discharge lamp has such a structure that a front end portion of a quartz-glass arc tube 5 is supported with one lead support 2 protruded forward from an insulating base 1, a rear end portion of the arc tube 5 is supported with a concave portion 1*a* of the base 1, and the arc tube 5 is sustained at a portion near its rear end with a metal supporting member 4 fixed to a front surface of the insulating base 1. A front end-side lead wire 8 led from the arc tube 5 is fixed to the lead support 2 by the welding, while a rear end-side lead wire 8 is passed through a bottom wall 1*b* constituting the concave portion 1*a* of the base 1 and secured to a terminal 3 provided to the bottom wall 1*b* by the welding. A symbol G is a cylindrical ultraviolet shielding globe made of the glass to cut off an ultraviolet component in a bandwidth that is harmful to a human body from the light that is emitted from the arc tube 5. This ultraviolet shielding globe G is deposited integrally to the arc tube 5.

Then, the arc tube 5 has such a structure that a closed glass globe 5*a* in which electrodes 6, 6 are provided between a pair of front and rear pinch sealed portions 5*b*, 5*b* to oppose to each other and into which luminous substances i.e., Na halides, Sc halides or Hg, are sealed together with a starting rare gas is formed. A molybdenum foil 7 for connecting the electrode 6 protruded into the closed glass globe 5*a* and the lead wire 8 led from the pinch sealed portion 5*b* is sealed in the pinch sealed portion 5*b*, and thus an air tightness in the pinch sealed portion 5*b* is maintained.

In this case, this Hg sealed in the closed glass globe 5*a* is a very useful buffer substance to relieve the damage of the electrode by maintaining a predetermined tube voltage and reducing an amount of collision of the electron to the electrode 6. However, such Hg is an environmentally hazardous material. For this reason, recently the development of the so-called mercury-free arc tube into which Hg acting as the environmentally hazardous material is not sealed is accelerated.

Then, in Japanese Patent Unexamined Publication No. JP-A-2002-93369, it was proposed that a second metal (at least one type or plural types of Mg, Fe, Co, Cr, Zn, Ni, Mn, Al, Sb, Be, Re, Ga, Ti, Zr, and Hf), which is hard to emit the light in the visible range rather than a first metal (Na or Sc) that is popular as the luminous substance, is sealed instead of Hg, and thus such Hg should not be sealed at all or a small amount of Hg should be sealed if any.

Then, in the course of the development of the mercury-free arc tube, the inventors trially manufactured the embodiments (referred to as "Literature Embodiments" hereinafter) that are disclosed in the Japanese Patent Unexamined Publication No. JP-A-2002-93369, and then examined a tube voltage, a luminous flux, and a luminous flux build-up of respective trial arc tubes within 0 time in practical use (referred to as "initial characteristics" hereinafter). At that time, none of them could satisfy all the initial characteristics, as shown in FIG. 15. In FIG. 15, Literature Embodiments 2, 3 provide the mercury-containing arc tube in which a minute quantity (1 mg) of Hg is sealed, respectively. Also, Literature Embodiments 1, 4 to 6 provide the mercury-free arc tube in which other metal halides are sealed instead of Hg respectively, wherein a $ScI_3$ sealed density is set to 2.8 mg/ml in Literature Embodiments 1 to 5 and a $ScI_3$ sealed density is set to 3.4 mg/ml in Literature Embodiment 6.

The inventors concluded that a cause of unsatisfactory initial characteristics lies in the low sealing pressure (0.1 or 0.5 MPa) of the rare gas (Xe-gas). Then, the inventors trially manufactured the mercury-containing arc tubes in which a minute amount (0.72 mg) of Hg is sealed, a $ScI_3$ sealing density is set to 3.28 mg/ml, and a Xe-gas sealing pressure is set differently respectively, as shown in FIGS. 2 and 3. Then, the initial characteristics are performed evaluation test. At this time, it was checked that, as shown in FIGS. 3 and 4, the Xe-gas sealing pressure of 0.6 MPa or more should be desired to satisfy the initial characteristics i.e., tube voltage, luminous flux and luminous flux build-up. In other words, it is estimated that the initial characteristics could be improved because a pressure in the closed glass globe is high when the tube is turned ON.

However, such a new problem has arisen that a flicker phenomenon of a light during its lightened state of the arc tube is generated. Hereinafter, this phenomenon is referred to as the "flicker".

Reaction formulas of the flicker occurring mechanism are given as shown in below.

$$4ScI_3+3SiO_2 \rightarrow 2Sc_2O_3+3SiI_4 \quad (1)$$

$$nW+SiI_4 \rightarrow SiW_n+2I_2 \quad (2)$$

$$4ScI_3+3ThO_2 \rightarrow 2Sc_2O_3+3ThI_4 \quad (3)$$

Such flicker occurring mechanism will be explained as follows.

That is, the quartz glass ($SiO_2$) constituting a tube wall of the arc tube reacted with $ScI_3$, as given by Formula (1), to generate a devitrification phenomenon. Then, $SiI_4$ generated at this time reacted with the tungsten electrode, as given by Formula (2), to generate a low-melting alloy (SiWn). Also, in the thoria-doped tungsten (which is also called thoriated tungsten) electrode, thoria ($ThO_2$) disappeared as given by Formula (3). Then an inter-electrode distance which is defined between the electrodes was expanded by the deformation or damage of the electrode, and also a re-ignition voltage was increased, so that a ballast uncontrollable state was brought about to cause the flicker. As a result, it is estimated that the reactions to cause the flicker are accelerated because the pressure in the arc tube (closed glass globe) is high when the tube is turned ON.

Here, the inventors concluded that $ScI_3$ is concerned largely with generation of the devitrification phenomenon and disappearance of the thoria, which result in the deformation of the electrode, and that any correlation exists between a $ScI_3$ sealing density and a flicker occurring rate.

Then, as shown in FIGS. 5 to 9, the inventors trially manufactured the arc tubes having different specifications while differentiating the internal volume of the closed chamber, the Xe gas sealing pressure, the $ScI_3$ sealing density, mercury contained or mercury not contained (the metal halide such as In halide, or the like is sealed in place of Hg as the sealed buffer substance), etc., and then examined whether or not the flicker occurred. At this time, it was derived from the data shown in FIGS. 5 to 9 that correlations shown in FIGS. 10 and 11 reside between the $ScI_3$ sealing density and the flicker occurring rate. The flicker occurring rate is increased sharply if the $ScI_3$ sealing density exceeds 4.7 mg/ml, and also deformation and damage of the top end portion of the electrode grow worse, which is shown that the inter-electrode distance is extended, as the $ScI_3$ sealing density becomes high and the flicker occurring rate becomes high.

That is, it was found that the $ScI_3$ sealing density should be lowered in order to lower the flicker occurring rate, and no flicker occurs at all if the $ScI_3$ sealing density is lowered rather than 4.7 mg/ml.

Also, it was confirmed that the correlation shown in FIG. 12 is present between the $ScI_3$ sealing density and the luminous efficiency (lumen/W) and also a lower limit of the $ScI_3$ sealing density should be set to 1.25 mg/ml because the luminous efficiency of at least 75 lumen/W is needed as the car lamp for example, a headlamp.

In this manner, in order to satisfy the initial characteristics i.e., tube voltage, luminous flux, and luminous flux build-up, of the arc tube for the discharge lamp, it is desired that the Xe gas sealing pressure should be set to 0.6 MPa or more, as shown in FIGS. 3 and 4. Then, it was confirmed that the flicker whose occurrence is worried when the Xe gas sealing pressure is set high i.e., 0.6 MPa or more, can be suppressed by setting the $ScI_3$ sealing density to 4.7 mg/ml or less, as shown in FIGS. 10 and 11, and the luminous efficiency i.e., 75 lumen/W or more, required as the car lamp can be assured (see FIG. 12) by setting the $ScI_3$ sealing density to 1.25 mg/ml or more. As a result, these findings lead the inventors to propose the present invention.

SUMMARY OF THE INVENTION

The present invention has been made in view of the problems in the related art and based on the findings of the inventors. It is an object of the present invention to provide a high-efficiency arc tube for a discharge lamp capable of satisfying initial characteristics (tube voltage, luminous flux, luminous flux build-up) and also preventing occurrence of a flicker.

In order to achieve the above object, according to a first aspect of the present invention, there is provided an arc tube for a discharge lamp, comprising:

a closed chamber filled with rare gas and a metal halide containing at least Na halide and Sc halide, an internal volume of the closed chamber being 50 μl or less; and electrodes provided so as to be opposed to each other, wherein sealing pressure of the rare gas is 0.6 MPa or more, and a sealing density of the Sc halide in the closed chamber is ranging from 1.25 to 4.70 mg/ml.

(Effect) In the arc tube according to the first aspect of the present invention, the correlations shown in FIGS. 3 and 4 lie between the Xe gas sealing pressure and the initial characteristics of the arc tube. Thus, in order to acquire the proper initial characteristics, the Xe gas sealing pressure must be set higher i.e., 0.6 MPa or more) than that in the conventional example such as the JP-A-2002-93369.

However, when the Xe gas sealing pressure is set higher (0.6 MPa or more) than that in the conventional example, a pressure in the closed chamber is increased correspondingly during the lightening state. Thus, the reactions that lead to the flicker occurrence given by above Formulas (1), (2), (3) are accelerated and also possibility of occurring of the flicker becomes higher. In this case, there exists the relationship shown in FIGS. 10 and 11 between the Sc halide sealing density and the flicker occurring rate, which is equivalent to the inter-electrode distance. Therefore, the flicker occurring rate can be reduced to 0 by setting the Sc halide sealing density to 4.70 mg/ml or less.

Also, there exists the relationship shown in FIG. 12 between the Sc halide sealing density and the luminous efficiency of the arc tube. Thus, if the Sc halide sealing density is set too low, the luminous efficiency becomes worse and also the arc tube cannot be utilized as the light source for the car lamp. As a result, if the Sc halide sealing density is set to 1.25 mg/ml or more, the luminous efficiency of 75 lumen/W of more, which is required as the light source for the car lamp, can be assured.

According to a second aspect of the present invention according to the first aspect of the present invention, it is preferable that the metal halide further containing In halide.

According to the second aspect of the present invention, other metal halides containing at least In act as the buffer substance instead of Hg, and the initial characteristics that are substantially identical to the initial characteristics of the mercury-containing arc tube can be obtained.

According to a third aspect of the present invention according to the first aspect of the present invention, it is more preferable that the metal halide further containing at least one of Sn halide or Zn halide.

According to a fourth aspect of the present invention according to the first aspect of the present invention, it is further preferable that the Sc halide is $ScI_3$.

According to a fifth aspect of the present invention according to the first aspect of the present invention, it is furthermore preferable that the closed chamber is made of $SiO_2$.

According to a sixth aspect of the present invention according to the first aspect of the present invention, it is suitable that the closed chamber is made of $Al_2O_3$.

According to a seventh aspect of the present invention according to the first aspect of the present invention, it is more suitable that the electrode is made of W.

According to an eighth aspect of the present invention according to the seventh aspect of the present invention, it is further suitable that the electrode contains $ThO_2$.

According to a ninth aspect of the present invention according to the first aspect of the present invention, it is furthermore suitable that the rare gas is a Xe gas.

According to a tenth aspect of the present invention according to the first aspect of the present invention, it is desirable that a halogen in the metal halide is I.

According to the present invention, since the Xe gas sealing pressure and the Sc halide sealing density are set in a predetermined range respectively, the high-efficiency arc tube for the discharge lamp, which can achieve the proper initial characteristics and can cause no flicker, can be provided.

According to the second aspect of the preset invention, since other metal halides containing at least In are sealed as the substance that is substituted for Hg as the environmentally hazardous material, the mercury-free arc tube for the discharge lamp having the substantially identical initial characteristics to the initial characteristics of the mercury-containing arc tube can be provided.

Note that the closed chamber functions as a discharging space.

Note that the arc tube for thee discharge lamp of the present invention is a mercury-free arc tube.

BRIEF DESCRIPTION OF THE DRAWINGS

FIG. 2 is a view showing specifications of the arc tube in the first embodiment (Experimental Example 1);

FIG. 3 is a view showing results of an evaluation test to examine a relationship between a Xe gas sealing pressure and initial characteristics in a table;

FIG. 5A is a is view showing specifications of an arc tube in a second embodiment (Experimental Example 2);

FIG. 5B is a view showing results of an evaluation test of the arc tube of the second embodiment;

FIG. 6A is a view showing specifications of an arc tube in a third embodiment (Experimental Example 3);

FIG. 6B is a view showing results of an evaluation test of the arc tube of the third embodiment;

FIG. 7A is a view showing specifications of an arc tube in a fourth embodiment (Experimental Example 4);

FIG. 7B is a view showing results of an evaluation test of the arc tube of the fourth embodiment;

FIG. 8A is a view showing specifications of an arc tube in a fifth embodiment (Experimental Example 5);

FIG. 8B is a view showing results of an evaluation test of the arc tube of the fifth embodiment;

FIG. 9A is a view showing specifications of an arc tube in a sixth embodiment (Experimental Example 6);

FIG. 9B is a view showing results of an evaluation test of the arc tube of the sixth embodiment;

FIG. 15 is a view showing specifications and initial characteristics of arc tubes in the JP-A-2002-93369.

DETAILED DESCRIPTION OF THE PREFERRED EMBODIMENTS

Next, embodiments of the present invention will be explained hereinafter.

Figure 1:
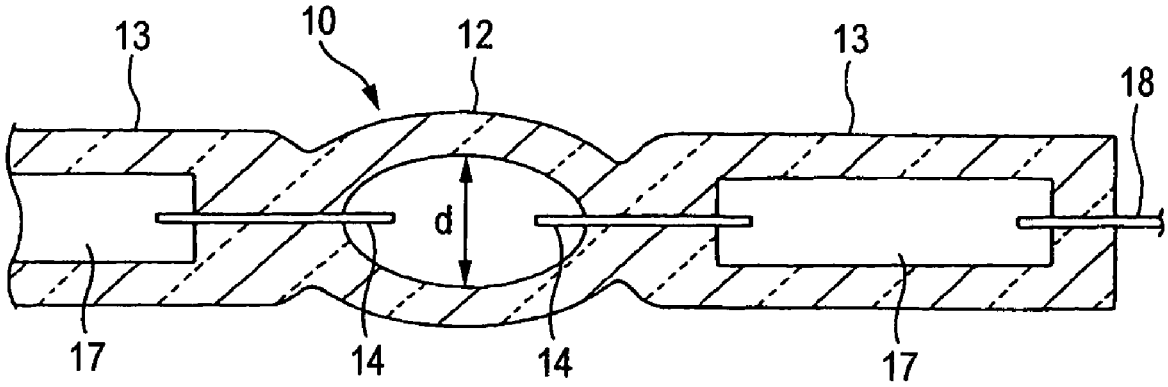
FIG. 1 is a longitudinal sectional view of a quartz-glass arc tube for a discharge lamp in a first embodiment of the present invention.
Figure 4:
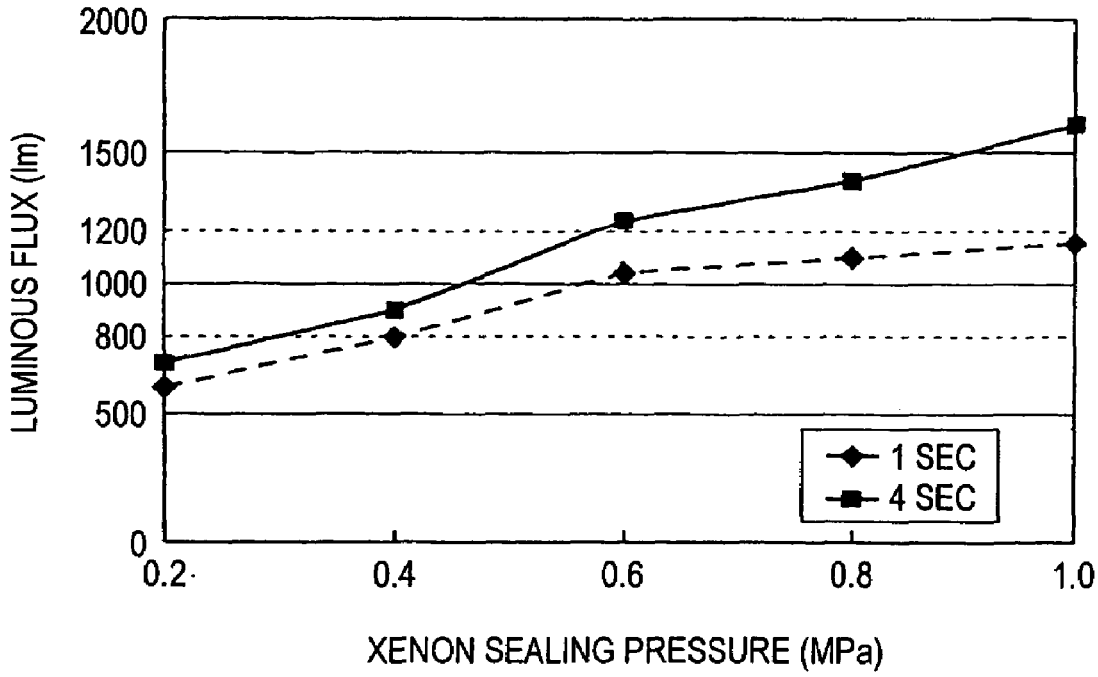
FIG. 4 is a view showing the results of the evaluation test with graphs.
Figure 10:
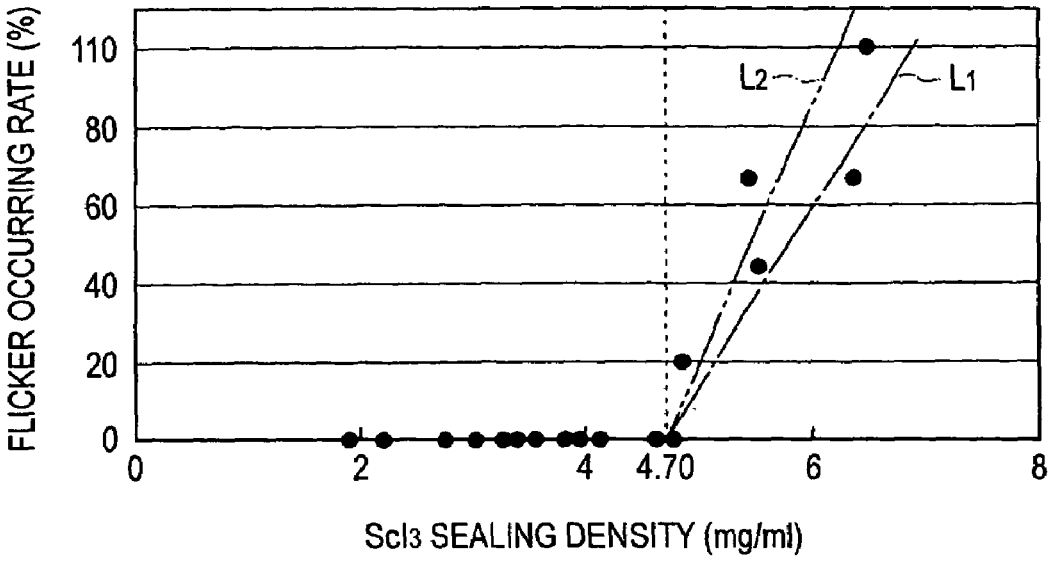
FIG. 10 is a view showing a relationship between a $ScI_3$ sealing density and a flicker occurring rate in the arc tubes in the first to sixth embodiments.
Figure 11:
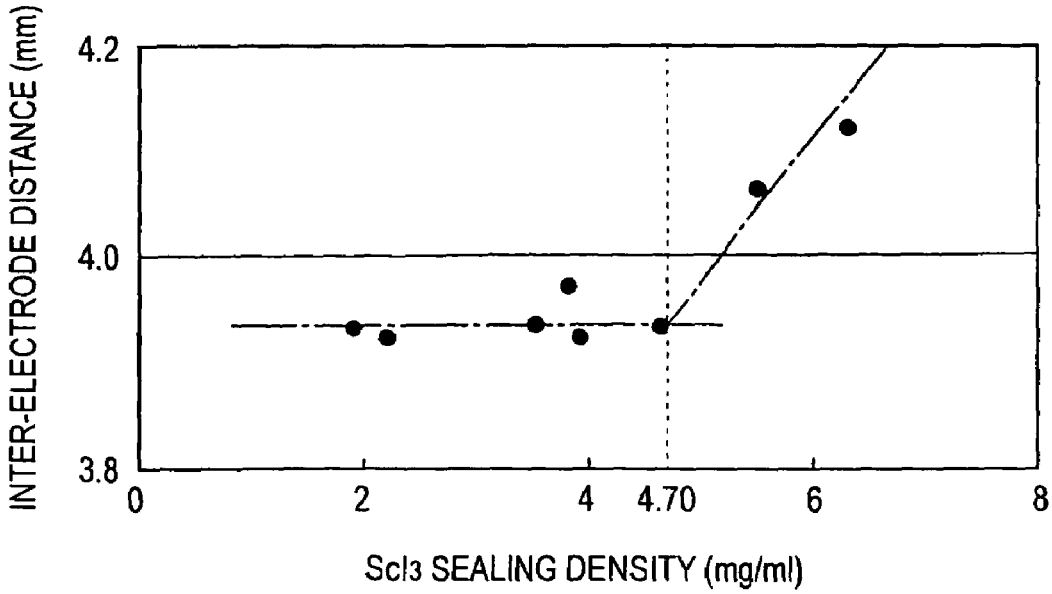
FIG. 11 is a view showing a relationship between the $ScI_3$ sealing density and an inter-electrode distance in the arc tubes of the first to sixth embodiments.
Figure 12:
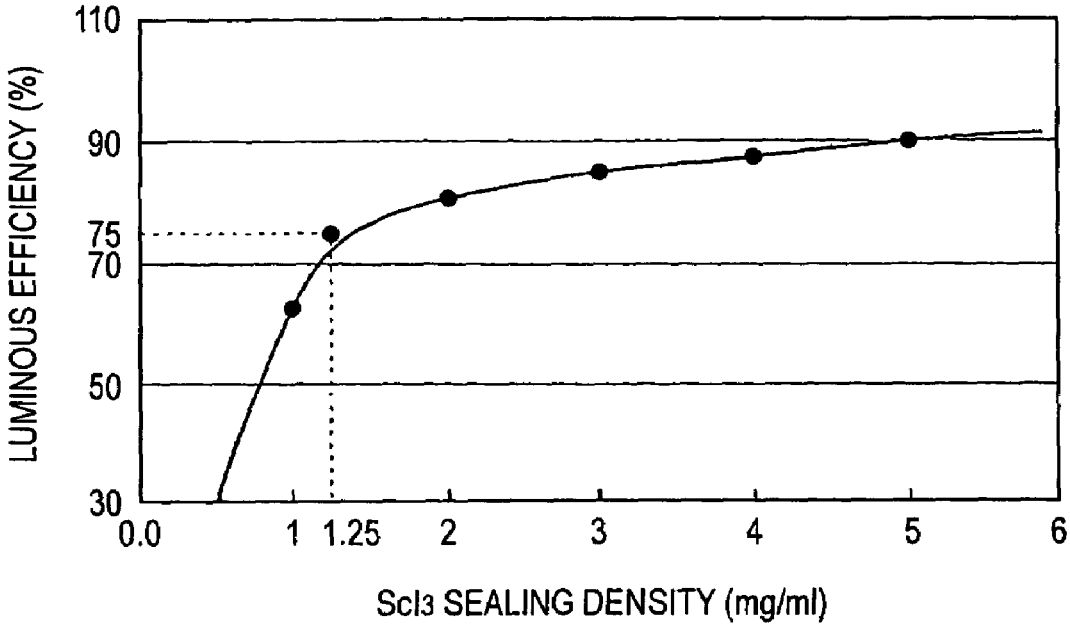
FIG. 12 is a view showing a relationship between the $ScI_3$ sealing density and a luminous efficiency (lumen/W) in the arc tubes of the first to sixth embodiments.

FIG. 1 to FIG. 12 show a first embodiment in which the present invention is applied to a quartz-glass arc tube for a discharge lamp. FIG. 1 is a longitudinal sectional view of a quartz-glass arc tube for a discharge lamp in a first embodiment of the present invention, FIG. 2 is a view showing specifications of the arc tube in the first embodiment (Experimental Example 1), FIG. 3 is a view showing results of an evaluation test to examine a relationship between a Xe gas sealing pressure and initial characteristics in a table, FIG. 4 is a view showing the results of the evaluation test with graphs, FIG. 5A is a is view showing specifications of an arc tube in a second embodiment (Experimental Example 2), FIG. 5B is a view showing results of an evaluation test of the arc tube of the second embodiment, FIG. 6A is view showing specifications of an arc tube in a third embodiment (Experimental Example 3), FIG. 6B is a view showing results of an evaluation test of the arc tube of the third embodiment, FIG. 7A is view showing specifications of an arc tube in a fourth embodiment (Experimental Example 4), FIG. 7B is a view showing results of an evaluation test of the arc tube of the fourth embodiment, FIG. 8A is view showing specifications of an arc tube in a fifth embodiment (Experimental Example 5), FIG. 8B is a view showing results of an evaluation test of the arc tube of the fifth embodiment, FIG. 9A is view showing specifications of an arc tube in a sixth embodiment (Experimental Example 6), FIG. 9B is a view showing results of an evaluation test of the arc tube of the sixth embodiment, FIG. 10 is a view showing a relationship between a $ScI_3$ sealing density and a flicker occurring rate in the arc tubes in the first to sixth embodiments, FIG. 11 is a view showing a relationship between the $ScI_3$ sealing density and an inter-electrode distance in the arc tubes of the first to sixth embodiments and FIG. 12 is a view showing a relationship between the $ScI_3$ sealing density and a luminous efficiency (lumen/W) in the arc tubes of the first to sixth embodiments.

Figure 14:
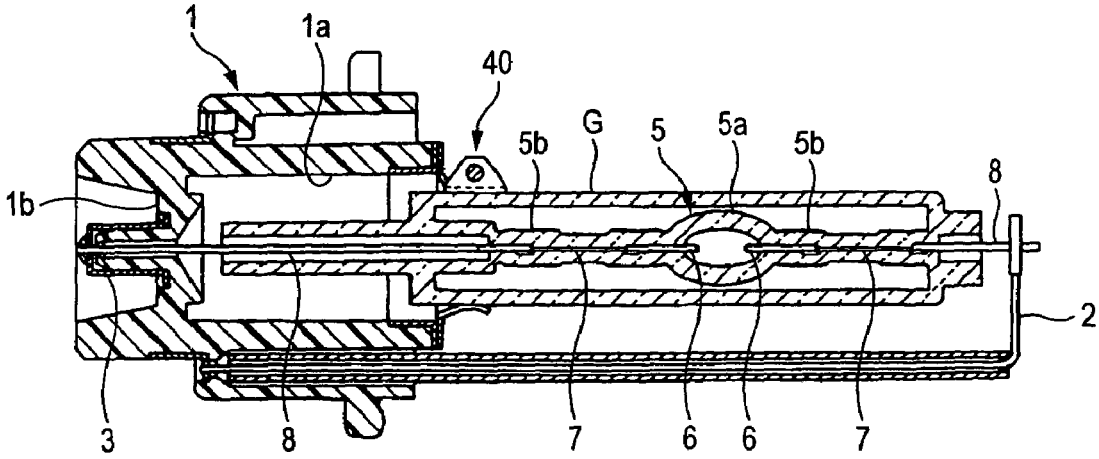
FIG. 14 is a longitudinal sectional view of a discharge lamp in the related art.

In FIG. 1 and FIG. 14, an overall structure of a discharge lamp, into which an arc tube 10 in the first embodiment is installed, is the same as the conventional structure shown in FIG. 14 except that a structure of the arc tube 10 is different. Their redundant explanation will be omitted here from.

The arc tube 10 shown in FIG. 1 has such a very compact structure that a circular-pipe quartz-glass tube, in which a spherically swollen portion is formed in the middle of its linearly extended portion in the longitudinal direction, is pinch-sealed at both end portions near the spherically swollen portion respectively and also pinch sealed portions 13, 13 each having a rectangular cross section are formed on both end portions of a chip less closed glass globe 12 that is formed like an elliptic shape or a circular-cylindrical shape to constitute a discharge space. Electrodes 14, 14 are provided in the closed glass globe 12 as a closed chamber to oppose to each other, and also metal halides (NaI, $ScI_3$) and Hg as well as a starting rare gas (Xe gas) are sealed in the closed glass globe 12. The electrodes 14, 14 are connected to a molybdenum foil 17 that is sealed in the pinch sealed portion 13. Molybdenum lead wires 18, 18 connected to the molybdenum foils 17, 17 are extended from end portions of the pinch sealed portions 13, 13 respectively. The electrode 14 is formed of a straight electrode rod made of thoria-doped tungsten, and the inter-electrode distance is set to 3.8 mm as a mechanical gap which is 4.2 mm as an optical gap. In this case, all the inter-electrode distances are given by the mechanical gap in this specification and the drawings.

Also, as shown in FIG. 2, the closed glass globe 12 has a maximum inner diameter d of 3.2 mm and an internal volume of 0.032 ml. NaI and $ScI_3$ having a total weight of 0.3 mg together with a minute quantity (0.72 mg) of Hg are sealed in the closed glass globe 12 at a rate of 65:35 (wt %). In this case, all Na, Sc, Xe acts as the luminous substance, and Hg acts as the luminous substance and the buffer substance.

Also, the Xe gas sealing pressure is set to 5 levels 0.2, 0.4, 0.6, 0.8, 1.0 MPa, as shown in FIG. 3. Three arc tubes whose Xe gas sealing pressure is set to 0.6 MPa or more respectively correspond to the first embodiment.

Also, as shown in FIG. 4, the initial characteristics (tube voltage, luminous flux, and luminous flux build-up) of the arc tube are substantially proportional to the Xe gas sealing pressure. In order to satisfy the initial characteristics (the tube voltage 85±12 V, the luminous flux build-up (1 sec) is 800 lumen or more, and the luminous flux build-up (4 sec) is 1200 lumen or more) of the arc tube required as a light source of the car headlamp, the Xe gas sealing pressure that is in excess of 0.6 MPa in the arc tube 10 (closed glass globe 12) is needed.

Then, in the present embodiment, the Xe gas sealing pressure in the closed glass globe 12 of the arc tube 10 is set to a value (0.6, 0.8, or 1.0 MPa) that is higher than a threshold value (0.6 MPa or more) required to get the proper initial characteristics. Therefore, this arc tube satisfies the initial characteristics of the arc tube required as the light source of the car headlamp.

FIG. 5 shows an arc tube in a second embodiment (Experimental Example 2), wherein FIG. 5A is view showing specifications of the arc tube in the second embodiment (Experimental Example 2), and FIG. 5B is a view showing results of an evaluation test of the same arc tube.

The closed glass globe 12 has a maximum inner diameter d of 3.2 mm and an internal volume of 0.032 ml, and an inter-electrode distance is set to 3.8 mm. NaI and $ScI_3$ having a total weight of 0.2 to 0.5 mg together with a minute quantity (0.72 mg) of Hg are sealed in the closed glass globe 12 at a predetermined rate shown in FIG. 5B.

Also, the $ScI_3$ sealing density is set to 8 levels from a minimum value of 1.9 to a maximum value of 6.3 mg/ml. The Xe gas sealing pressure is set to 0.78 MPa that is higher than a threshold value (0.6 MPa or more) required to get the proper initial characteristics.

Then, six types of arc tubes, whose $ScI_3$ sealing density is set to 1.9 to 4.7 mg/ml respectively, out of eight arc tubes having different specifications correspond to the second embodiment of the present invention.

FIG. 6 shows an arc tube in a third embodiment (Experimental Example 3), wherein FIG. 6A is view showing specifications of the arc tube in the third embodiment (Experimental Example 3), and FIG. 6B is a view showing results of an evaluation test of the same arc tube.

The closed glass globe 12 has a maximum inner diameter d of 2.6 mm and an internal volume of 0.023 ml, and an inter-electrode distance is set to 3.8 mm. NaI and $ScI_3$ having a total weight of 0.2 mg together with a minute quantity (0.72 mg) of Hg are sealed in the closed glass globe 12 at a rate of 65:35 (wt %). The Xe gas sealing pressure is set to 0.78 MPa that is higher than a threshold value (0.6 MPa or more) required to get the proper initial characteristics.

Also, the $ScI_3$ sealing density is set to two levels 3.0 and 3.5 mg/ml. The arc tubes having either specification of them correspond to a third embodiment of the present invention.

FIG. 7 shows an arc tube in a fourth embodiment (Experimental Example 4), wherein FIG. 7A is view showing specifications of the arc tube in the fourth embodiment (Experimental Example 4), and FIG. 7B is a view showing results of an evaluation test of the same arc tube.

The closed glass globe 12 has a maximum inner diameter d of 2.7 mm and an internal volume of 0.024 ml, and an inter-electrode distance is set to 3.8 mm. NaI and $ScI_3$ having a total weight of 0.2 mg together with a minute quantity (0.72 mg) of Hg are sealed in the closed glass globe 12 at a rate of 65:35 (wt %). The Xe gas sealing pressure is set to 0.78 MPa that is higher than a threshold value (0.6 MPa or more) required to get the proper initial characteristics, and the $ScI_3$ sealing density is set to 2.9 mg/ml.

FIG. 8 shows an arc tube (mercury-free arc tube) in a fifth embodiment (Experimental Example 5), wherein FIG. 8A is a view showing specifications of the arc tube in the fifth embodiment (Experimental Example 5), and FIG. 8B is a view showing results of an evaluation test of the same arc tube.

The closed glass globe 12 has a maximum inner diameter d of 2.5 mm and an internal volume of 0.020 ml, and an inter-electrode distance is set to 3.8 mm. NaI, $ScI_3$, InI, $SnI_2$ having a total weight of 0.2 to 0.4 mg are sealed in the closed glass globe 12 at a rate of 60:32:2:6 (wt %). InI and $SnI_2$ act as the buffer substance in place of Hg.

Also, the Xe gas sealing pressure is set to 1.0 MPa or 1.1 MPa that is higher than a threshold value (0.6 MPa or more) required to get the proper initial characteristics, and the $ScI_3$ sealing density is set to three levels 3.2, 4.8, 6.4 mg/ml. Only one type arc tube whose $ScI_3$ sealing pressure is 3.2 mg/ml corresponds to the fifth embodiment of the present invention.

FIG. 9 shows an arc tube (mercury-free arc tube) in a sixth embodiment (Experimental Example 6), wherein FIG. 9A is a view showing specifications of the arc tube in the sixth embodiment (Experimental Example 6), and FIG. 9B is a view showing results of an evaluation test of the same arc tube.

The closed glass globe 12 has a maximum inner diameter d of 2.5 mm and an internal volume of 0.020 ml, and an inter-electrode distance is set to 3.8 mm. NaI, $ScI_3$, InI, $ZnI_2$ having a total weight of 0.2 to 0.4 mg are sealed in the closed glass globe 12 at a rate of 57.5:27:0.5:15 (wt %) or a rate of 62.5:27:1.5:9 (wt %). The InI and $ZnI_2$ act as the buffer substance instead of Hg.

Also, the Xe gas sealing pressure is set to 1.0 MPa or 1.1 MPa that is higher than a threshold value (0.6 MPa or more) required to get the proper initial characteristics, and the $ScI_3$ sealing density is set to three levels 2.7, 4.1, 5.4 mg/ml. Then, five of six types of arc tubes whose $ScI_3$ sealing density is 2.7 mg/ml or 4.1 mg/ml respectively, correspond to the sixth embodiment of the present invention.

Also, based on the data of the lifetime evaluation test using the arc tubes in the first embodiment (Experimental Example 1) to the sixth embodiment (Experimental Example 6) and shown in FIGS. 1 to 9, it was checked whether or not the flicker occurs, and others. At that time, it was checked that correlations shown in FIGS. 10 and 11 reside between the $ScI_3$ sealing density and the flicker occurring rate which is represented by the inter-electrode distance, and the flicker occurring rate is increased sharply if the $ScI_3$ sealing density exceeds 4.7 mg/ml. Also, deformation and damage of the top end portion of the electrode grow worse, which is shown by the inter-electrode distance being extended, as the $ScI_3$ sealing density becomes high and the flicker occurring rate becomes high. In this case, a symbol L1 in FIG. 10 shows a characteristic straight line of the second to fourth embodiments in which the Xe gas sealing pressure is 0.78 MPa, and a symbol L2 shows a characteristic straight line of the fifth and sixth embodiments in which the Xe gas sealing pressure is 1.0 or 1.1 MPa.

That is, the $ScI_3$ sealing density should be lowered to lower the flicker occurring rate. If the $ScI_3$ sealing density is set to 4.7 mg/ml or less, the flicker in no way occurs.

Also, it was appreciated that the correlation shown in FIG. 12 is present between the $ScI_3$ sealing density and the luminous efficiency (lumen/W) and also a lower limit of the $ScI_3$ sealing density should be set to 1.25 mg/ml because the luminous efficiency of at least 75 lumen/W is needed as the car lamp.

In this manner, in order to satisfy the initial characteristics (the tube voltage, the luminous flux, and the luminous flux build-up) of the arc tube for the discharge lamp, it is desired that the Xe gas sealing pressure should be set to 0.6 MPa or more. Also, the flicker whose occurrence is worried when the Xe gas sealing pressure is set high (0.6 MPa or more) can be suppressed by setting the $ScI_3$ sealing density to 4.7 mg/ml or less. Also, the luminous efficiency (75 lumen/W or more) required as the car lamp can be assured by setting the $ScI_3$ sealing density to 1.25 mg/ml or more.

Then, in all embodiments of the first to sixth embodiments of the present invention, the Xe gas sealing pressure is set to 0.6 MPa or more and the $ScI_3$ sealing density is set in a range of 1.25 to 4.70 mg/ml. Therefore, the high-efficiency arc tube that can achieve the proper initial characteristics and can cause no flicker and that is mostly suited to the light source for the car headlamp can be obtained.

Figure 13:
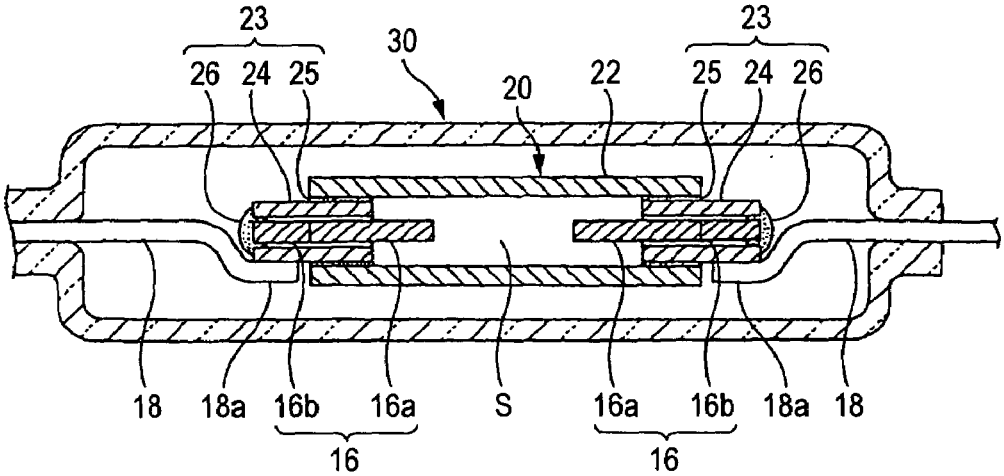
FIG. 13 is a longitudinal sectional view of a pertinent portion of a ceramic arc tube for a discharge lamp in a second embodiment of the present invention.

FIG. 13 shows a second embodiment in which the present invention is applied to a ceramic arc tube, and is a longitudinal sectional view showing a pertinent portion of the ceramic arc tube for the discharge lamp in the second embodiment of the present invention.

The lead wire 18 connected electrically to an electrode 16, which is protruded into a closed space S as the closed chamber, is extended from front and rear end portions of a ceramic arc tube 20 respectively, and an ultraviolet shielding shroud glass 30 is sealed onto the lead wires 18. Thus, both the arc tube 20 and the shroud glass 30 are assembled integrally with each other.

The arc tube is constituted such that both end portions of a translucent ceramic tube 22 having a right cylindrical shape are sealed, the electrodes 16, 16 are provided in the closed space S in the ceramic tube 22 to oppose to each other, and the metal halides, and the like as well as the starting rare gas (Xe gas) are sealed in the arc tube. The lead wire 18 is jointed to the front and rear sealed portions of the ceramic tube 22 respectively to extend in a coaxial manner.

A symbol 24 is a molybdenum pipe used to seal opening portions on both ends of the arc tube 20 which is ceramic tube 22 and fix the electrode 16. A symbol 25 is a metallized layer that seals the opening portions on both ends of the ceramic tube 22 by jointing the ceramic tube 22 to the molybdenum pipe 24.

The electrode 16 is constructed by jointing a top end-side tungsten portion 16*a* and a base end-side molybdenum portion 16*b* integrally coaxially by virtue of the welding. Then, the electrode 16 is secured to the ceramic tube 22 via the molybdenum pipe 24 by welding the molybdenum portion 16*b* to the molybdenum pipe 24. A symbol 26 is a laser-welded portion. Then, a top-end bended portion 18*a* of the molybdenum lead wire 18 is secured to the molybdenum pipe 24 projected from the front and rear ends of the ceramic tube 22 respectively by the welding, so that the lead wires 18 and the electrodes 16 are arranged on the same axis.

In other words, the molybdenum pipe 24 is secured to both end portions of the ceramic tube 22 by the metallization jointing, and also the molybdenum portion 16*b* of the electrode 16 is welded to the pipe 24. Thus, sealing portions 23 of the ceramic tube 22 are constructed. Therefore, the sealing portion 23 of the ceramic tube 22 signifies the end portion of the ceramic tube 22 that is sealed via the molybdenum pipe 24 and, in more detail, signifies the molybdenum pipe 24, the laser-welded portion 26, and the metallized layer 25.

Also, the ceramic tube 22 is constructed very compact to have an outer diameter of 2.0 to 4.0 mm, a length of 8.0 to 12.0 mm, and an internal volume of 50 μl or less in the closed space S put between the sealing portions 23, 23. Also, the ceramic tube 22 is constructed to secure a high heat resistance and great durability and emit the light substantially uniformly from the overall arc tube 20 (luminous tube 22).

Also, like the case in the above first embodiment, a minute Hg in addition to the metal halides (NaI, $ScI_3$) is sealed together with the Xe gas in the closed space S when the arc tube is constructed according to the mercury-containing specification, whereas the metal halides InI, $SnI_2$ or InI, $ZnI_2$ in addition to the metal halides (NaI, $ScI_3$) are sealed together with the Xe gas in the closed space S when the arc tube is constructed according to the mercury-free specification.

In other words, the flicker occurring mechanism in the ceramic arc tube 20 (ceramic tube 22) will be explained similarly to the flicker occurring mechanism (reaction formulas) given by the above reaction formulas (1) to (3) in the quartz-glass arc tube by substituting the reaction formula of the ceramics ($Al_2O_3$) constituting the ceramic tube 22 for the reaction formula of the quartz glass ($SiO_2$).

Then, like the case of the quartz-glass arc tube, the devitrification phenomenon is generated and the low-melting alloy (AlWn) is generated. Also, in the thoria-doped tungsten electrode, the thoria ($ThO_2$) disappears to cause deformation of the electrode (expansion of the inter-electrode distance), increase in the re-ignition voltage, and occurrence of the flicker because of the ballast uncontrollable state. Therefore, in the case of the ceramic arc tube, like the case of the first embodiment (quartz-glass arc tube), not only the proper initial characteristics can be obtained but also the flicker occurrence can be suppressed if the $ScI_3$ sealing density and the Xe gas sealing pressure are adjusted.

Then, in the case of the ceramic arc tube having either the mercury-free specification or the mercury-containing specification, like the case of the above first embodiment, the $ScI_3$ sealing density is set in a range of 1.25 to 4.70 mg/ml and also the Xe gas sealing pressure is set to 0.6 MPa or more. Therefore, the high-efficiency ceramic arc tube that can achieve the proper initial characteristics and can cause no flicker and that is optimum as the light source for the car headlamp can be obtained.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. An arc tube for a discharge lamp, comprising:

a closed chamber filled with rare gas and a metal halide containing at least Na halide and Sc halide, an internal volume of the closed chamber being 50 μl or less; and electrodes provided so as to be opposed to each other, wherein sealing pressure of the rare gas is 0.6 MPa or more, a sealing density of the Sc halide in the closed chamber is in the range of 2.00 to 4.70 mg/ml;

wherein the closed chamber is made of $SiO_2$; and wherein Zn halide is also included in the closed chamber.

2. An arc tube for a discharge lamp as set forth in claim 1, wherein the metal halide further containing In halide.

3. An arc tube for a discharge lamp as set forth in claim 1, wherein the metal halide further contains Sn halide.

4. An arc tube for a discharge lamp as set forth in claim 1, wherein the Sc halide is $ScI_3$.

5. An arc tube for a discharge lamp as set forth in claim 1, wherein the closed chamber is made of $Al_2O_3$.

6. An arc tube for a discharge lamp as set forth in claim 1, wherein the electrode is made of W.

7. An arc tube for a discharge lamp as set forth in claim 6, wherein the electrode contains $ThO_2$.

8. An arc tube for a discharge lamp as set forth in claim 1, wherein the rare gas is a Xe gas.

9. An arc tube for a discharge lamp as set forth in claim 1, wherein a halogen in the metal halide is I.

10. An arc tube for a discharge lamp, comprising:

a closed chamber filled with rare gas, mercury and a metal halide containing at least Na halide and Sc halide, an internal volume of the closed chamber being 50 μl or less; and electrodes provided so as to be opposed to each other, wherein sealing pressure of the rare gas is 0.6 MPa or more, and a sealing density of the Sc halide in the closed chamber is in the range of 1.25 to 4.70 mg/ml.

11. An arc tube for a discharge lamp as set forth in claim 10, wherein the sealing density of the Sc halide in the closed chamber is in the range of 2.00 to 4.70 mg/ml.

12. An arc tube for a discharge lamp as set forth in claim 11, wherein arc tube is a quartz-glass arc tube;

wherein the metal halide includes NaI and $ScI_3$;

wherein the rare gas is Xe;

wherein the electrodes are formed of straight electrode rods made of thoria-doped tungsten; and wherein there is a mechanical gap of 3.8 mm between the electrodes.

* * * * *